United States Patent [19]

Robson

[11] Patent Number: 4,502,971

[45] Date of Patent: Mar. 5, 1985

[54] CONCENTRATES OF LUBRICANT ADDITIVES

[75] Inventor: Robert Robson, Oxford, England

[73] Assignee: Exxon Research & Engineering Co., Florham Park, N.J.

[21] Appl. No.: 475,304

[22] Filed: Mar. 14, 1983

[30] Foreign Application Priority Data

Mar. 24, 1982 [GB] United Kingdom ..... 8208697

[51] Int. Cl.[3] ..... C10M 1/32; C10M 1/54

[52] U.S. Cl. ..... 252/33.3; 252/40.5; 252/42; 252/42.7; 252/51.5 R

[58] Field of Search ..... 252/33.3, 51.5 R, 42.7, 252/40.5, 42

[56] References Cited

U.S. PATENT DOCUMENTS

| | | | |
|---|---|---|---|
| Re. 26,433 | 8/1968 | LeSuer | 252/33.6 |
| 3,182,019 | 5/1965 | Wilks et al. | 252/32.7 |
| 3,945,933 | 3/1976 | Chibnik | 252/33.3 |

*Primary Examiner*—Jacqueline V. Howard

*Attorney, Agent, or Firm*—Frank T. Johmann

[57] ABSTRACT

Dispersants and basic magnesium detergents tend to interact when mixed in additive concentrates and in bulk lubricants resulting in an undesirable increase in viscosity. It has been found that this problem may be significantly reduced if the dispersant is prereacted with a basic salt containing an alkali metal such as sodium, preferably in an amount corresponding to at least 0.001 gram atoms alkali metal per 100 grams dispersant. The reaction product may be used in concentrates containing basic magnesium detergents for use in lubricants.

13 Claims, 1 Drawing Figure

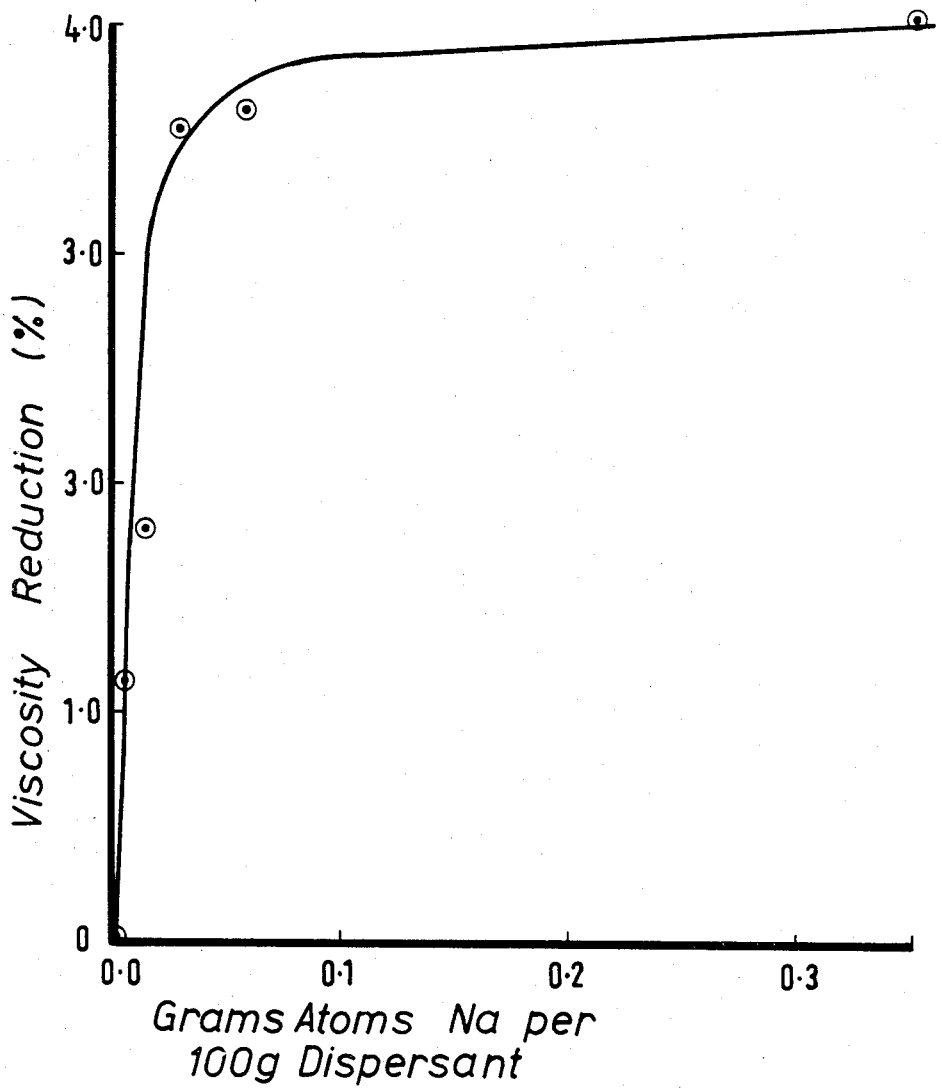
4·0
3·0
3·0
1·0
0
Viscosity Reduction (%)
0·0
0·1
0·2
0·3
Grams Atoms Na per
100g Dispersant

CONCENTRATES OF LUBRICANT ADDITIVES

This invention relates to the treatment of certain lubricating oil additives to alleviate or prevent viscosity problems when these additives are used in concentrated packages intended for blending into finished lubricating oil formulations. More particularly, it involves pretreatment of the dispersant when such additives are to be used in concentrated packages that will contain basic metal oil-soluble compounds as additives. It is believed that the pretreatment inhibits interaction between additives that can cause an increase in molecular weight thereby producing concentrates of unacceptably high viscosity.

In modern day usage, lubricating oil formulations that are intended for exacting or heavy duty service such as in automatic transmissions or automobile crankcases contain several different types of additives that will supply the characteristics that are required in the formulations. Among these types of additives are included viscosity index improvers, antioxidants, corrosion inhibitors, detergents and dispersants, pour point depressants, and antiwear agents. Obviously all of these various types of additives must be satisfactorily compatible so that each will not interfere with the functions of the others nor react with each other and destroy their nature or reduce their solubility, and cause haze or sediment or give unduly viscous products.

In the preparation of lubricating oil blends it is now common practice to introduce the additives in the form of concentrates in hydrocarbon oil, e.g. mineral lubricating oil, or other suitable solvent, typically containing from 10 to 80 wt %, e.g. 20 to 80 wt %, of active ingredient. Usually these concentrates may be diluted with 3 to 40, e.g. 5 to 20 parts by weight of lubricating oil, per part by weight of the additive package, in forming finished lubricants, e.g. crankcase motor oils. The purpose of concentrates, is of course, to make the handling of the various materials less awkward as well as to facilitate solution or dispersion in the final blend. Thus, a metal hydrocarbyl sulfonate or a metal alkyl phenate would be usually employed in the form of a 40 to 50 wt % concentrate, for example, in a lubricating oil fraction. Ordinarily when preparing a lubricating oil blend that contains several types of additives no problems arise where each additive is incorporated separately in the form of a concentrate in oil. In many instances, however, the additive supplier will want to make available an additive "package" comprising a number of additives in a single concentrate in a hydrocarbon oil or other suitable solvent. Sometimes particular types of additives may tend to react with each other at the concentrations used in such concentrates or and cause haze or sediment to form.

For easy handling it is important that these concentrates have a low viscosity and that the viscosity is stable and predictable from one concentrate to another since variations can cause the user considerable problems. It has been found that the dispersants traditionally used in lubricating oils and the basic metal containing additives can intereact in both an additive package and in bulk lubricants to result in an undesirable increase in viscosity. Furthermore, this increase can at times continue even in the finished lubricating oil.

We have now found that these problems may be significantly reduced in packages containing dispersant and oil-soluble basic magnesium compounds if the dispersant is pre-reacted with an alkali metal, preferably a sodium containing compound prior to blending with other additives. Oil soluble metal salts of substituted succinic acid acylated aliphatic polyamines, which may be used as dispersants, are described in U.S. Pat. No. Re. 26,433 where they are prepared by reacting 2 equivalents of a succinic compound one equivalent of a basic metal reactant and 1 to 5 equivalents of an amine. The basic metal reactant may be, inter alia an alkali metal compound but there is no disclosure of the treatment of dispersants with low amounts of the alkali metal or of the improvement of the compatability of the dispersant with a basic magnesium compound.

The present invention therefore provides a process for improving the compatibility of an ashless dispersant with basic oil-soluble magnesium compounds comprising pre-reacting the dispersant with a basic salt of an alkali metal, e.g. a sodium containing compound prior to mixing the dispersant with the magnesium compound to give the final additive package. The basic alkali metal salt is preferably present in an amount corresponding to at least 0.001 gram atoms of alkali metal per 100 grams of dispersant, and the invention further provides a dispersant containing from 0.001 to 0.05 gram atoms alkali metal/100 gram dispersant.

In a further embodiment the invention provides an additive concentrate for incorporation into lubricating oil containing from 0.2% to 5% by weight of an oil-soluble basic magnesium compound and from 2% to 10% by weight of a dispersant containing from 0.001 gram atoms to 0.075 gram atoms of an alkali metal, per 100 grams dispersant.

The dispersant to which the present invention relates may be traditional lubricating oil ashless dispersant compounds such as derivatives of long chain hydrocarbon substituted carboxylic acids in which the hydrocarbon groups contain 50 to 400 carbon atoms. These will generally be a nitrogen containing ashless dispersant having a relatively high molecular weight aliphatic hydrocarbon oil solubilising group attached thereto or an ester of a succinic acid/anhydride with a high molecular weight aliphatic hydrocarbon attached thereto and derived from monohydric and polyhydric alcohols, phenols and naphthols.

The nitrogen containing dispersant additives are those known in the art as sludge dispersants for crankcase motor oils. These dispersants include mineral oil-soluble salts, amides, imides, oxazolines and esters of mono- and dicarboxylic acids (and where they exist the corresponding acid anhydrides) of various amines and nitrogen containing materials having amino nitrogen or heteroyclic nitrogen and at least one amido or hydroxy group capable of salt, amide, imide, oxazoline or ester formation. Other nitrogen containing dispersants which may be used in this invention include those wherein a nitrogen containing polyamine is attached directly to the long chain aliphatic hydrocarbon as shown in U.S. Pat. Nos. 3,275,554 and 3,565,804 where the halogen group on the halogenated hydrocarbon is displaced with various alkylene polyamines.

Another class of nitrogen containing dispersants which may be used are those containing Mannich base or Mannich condensation products as they are known in the art. Such Mannich condensation products generally are prepared by condensing about 1 mole of an alkyl substituted phenol with about 1 to 2.5 moles of formaldehyde and about 0.5 to 2 moles polyalkylene polyamine as disclosed, e.g. in U.S. Pat. No. 3,442,808. Such Mannich condensation products may include a long chain, high molecular weight hydrocarbon on the phenol group or may be reacted with a compound containing such a hydrocarbon, e.g. alkenyl succinic anhydride as shown in said aforementioned U.S. Pat. No. 3,442,808.

Monocarboxylic acid dispersants have been described in U.K. Patent Specification No. 983,040. Here, the high molecular weight monocarboxylic acid can be derived from a polyolefin, such as polyisobutylene, by oxidation with nitric acid or oxygen; or by addition of halogen to the polyolefin followed by hydrolyzing and oxidation. Another method is taught in Belgian Pat. No. 658,236 where polyolefins, such as polymers of $C_2$ to $C_5$ monoolefin, e.g. polypropylene or polyisobutylene, are halogenated, e.g. chlorinated, and then condensed with an alpha-beta-unsaturated, monocarboxylic acid of from 3 to 8, preferably 3 to 4, carbon atoms, e.g. acrylic acid, alpha-methyl-acrylic acid, etc. Esters of such acids, e.g. ethyl methacrylate, may be employed if desired in place of the free acid.

The most commonly used dicarboxylic acid is alkenyl succinic anhydride wherein the alkenyl group contains from 50 to 400 carbon atoms.

Primarily because of its ready availability and low cost, the hydrocarbon portion of the mono- or dicarboxylic acid or other substituted group is preferably derived from a polymer of a $C_2$ to $C_5$ monoolefin, said polymer generally having a molecular weight of 700 to 5000. Particularly preferred is polyisobutylene.

Polyalkyleneamines are usually the amines used to make the dispersant. These polyalkyleneamines include those represented by the general formula:

$$H_2N(CH_2)_n—[NH(CH_2)_n]_m—NH(CH_2)_nNH_2$$

wherein n is 2 or 3, and m is 0 to 10. Examples of such polyalkyleneamines include diethylene triamine, tetraethylene pentamine, octaethylene nonamine, tetrapropylene pentamine, as well as various cyclic polyalkyleneamines.

Dispersants formed by reacting alkenyl succinic anhydride, e.g. polyisobutenyl succinic anhydride and an amine are described in U.S. Pat. Nos. 3,202,678, 3,154,560, 3,172,892, 3,024,195, 3,024,237, 3,219,666, 3,216,936 and Belgium Pat. No. 662,875.

Alternatively dispersants may be an ester derived from any of the aforesaid long chain hydrocarbon substituted carboxylic acids and from hydroxy compounds such as monohydric and polyhydric alcohols or aromatic compounds such as phenols or naphthols. The polyhydric alcohols are the most preferred hydroxy compound and preferably contain from 2 to 10 hydroxy radicals, for example, ethylene glycol, diethylene glycol, triethylene glycol, tetraethylene glycol, diproplyene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol.

The ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding the esters of this invention comprise the ether-alcohols and amino-alcohols including, for example, the oxy-alkylene-, oxy-arylene-, amion-alkylene-, and amino-arylene-substituted alcohols having one or more oxy-alkylene, amino-alkylene or amino-arylene oxy-arylene radicals. They are exemplified by Cellosolve, Carbitol, and N,N,N',N'-tetrahydroxytrimethylene diamine. For the most part, the etheralcohols having up to 150 oxy-alkylene radicals in which the alkylene radical contains from 1 to 8 carbon atoms are preferred.

The ester dispersant may be di-esters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester dispersant may be prepared by one of several known methods as illustrated for example in U.S. Pat. No. 3,522,179.

Hydroxyamines which can be reacted with any of the aforesaid long chain hydrocarbon substituted carboxylic acids to form dispersants include 2-amino-1-butanol, 2-amino-2-methyl-1-propanol, p-(beta-hydroxyethyl)-aniline, 2-amino-1-propanol, 3-amino-1-propanol, 2-amino-2-methyl-1, 3-propane-diol, 2-amino-2-ethyl-1, 3-propanediol, N-(betahydroxy-propyl)-N'-(beta-aminoethyl)-piperazine, tris(hydroxmethyl) amino-methane (also known as trismethylolaminomethane), 2-amino-1-butanol, ethanolamine and beta-(betahydroxyethoxy)-ethylamine. Mixtures of these or similar amines can also be employed.

The preferred dispersants are those derived from polyisobutenyl succinic anhydride and polyethylene amines, e.g. tetraethylene pentamine, polyoxyethylene and polyoxypropylene amines, e.g. polyoxypropylene diamine, trismethylolaminomethane and pentaerythritol, and combinations thereof. One preferred dispersant combination involves a combination of (A) polyisobutenyl succinic anhydride with (B) a hydroxy compound, e.g. pentaerythritol, (C) a polyoxyalkylene polyamine, e.g. polyoxypropylene diamine, and (D) a polyalkylene polyamine, e.g. polyethylene diamine and tetraethylene pentamine using about 0.01 to about 4 equivalents of (B) and (D) and about 0.01 to about 2 equivalents of (C) per equivalent of (A) as described in U.S. Pat. No. 3,804,763. Another preferred dispersant combination involves the combination of (A) polyisobutenyl succinic anhydride with (B) a polyalkylene polyamine, e.g. tetraethylene pentamine, and (C) a polyhydric alcohol or polyhydroxy-substituted aliphatic primary amine, e.g. pentaerythritol or trismethylolaminomethane as described in U.S. Pat. No. 3,632,511.

The alkenyl succinic polyamine type dispersants can be further modified with a boron compound such as boron oxide, boron halides, boron acids and ester of boron acids in an amount to provide about 0.1 to about 10 atomic proportions of boron per mole of the acylated nitrogen compound as generally taught in U.S. Pat. Nos. 3,087,936 and 3,254,025. Mixtures of dispersants can also be used such as those described in U.S. Pat. No. 4,113,639.

Typically the concentrates contain from 10 to 60 wt % of the dispersant and are incorporated into the lubricating oil to provide from 1.0 to 10 wt % preferably 2.0 to 7.0 wt % of dispersants.

The present invention may also be used with polymeric Viscosity Index improver dispersant such as:

(a) polymers comprised of $C_4$ to $C_{24}$ unsaturated esters vinyl of vinyl alcohol or $C_3$ to $C_{10}$ unsaturated mono- or di-carboxylic acid with unsaturated nitrogen containing monomers having 4 to 20 carbons (b) polymers of $C_2$ to $C_{20}$ olefin with unsaturated $C_3$ to $C_{10}$ mono- or di-carboxylic acid neutralised with amine, hydroxy amine or alcohols (c) polymers of ethylene with a $C_3$ to $C_{20}$ olefin further reacted either by grafting $C_4$ to $C_{20}$ unsaturated nitrogen containing monomers thereon or by grafting an unsaturated acid onto the polymer backbone and then reacting said carboxylic acid groups with amine, hydroxy amine or alcohol.

In these polymers the amine, hydroxy amine or alcohol "mono- or poly-hydric" may be as described above in relation to the ashless dispersants compounds.

Preferred Viscosity Index Improver dispersant have a number average molecular weight range as by vapor phase osmometry, membrane osmometry, or gel permeation chromatography, of 1000 to 2,000,000; preferably 5,000 to 250,000 and most preferably 10,000 to 200,000. It is also preferred that the polymers of group (a) comprise a major weight amount of unsaturated ester and a minor, e.g. 0.1 to 40 preferably 1 to 20 wt percent of a nitrogen containing unsaturated monomer, said weight percent based on total polymer. Preferably the polymer group (b) comprises 0.1 to 10 moles of olefin preferably 0.2 to 5 moles $C_2$–$C_{20}$ aliphatic or aromatic olefin moieties per mole of unsaturated carboxylic acid moiety and that from 50 percent to 100 percent, of the acid moieties are neutralized. Preferably the polymer of group (c) comprises an ethylene copolymer of 25 to 80 wt percent ethylene with 75 to 20 wt percent $C_3$ to $C_{20}$ mono and/or diolefin, 100 parts by weight of ethylene copolymer being grafted with either 0.1 to 40, preferably 1 to 20 parts by weight unsaturated nitrogen containing monomer, or being grafted with 0.01 to 5 parts by weight of unsaturated $C_3$ to $C_{10}$ mono or dicarboxylic acid, which acid is 50 percent or more neutralized.

The unsaturated carboxylic acids used in (a), (b) and (c) above will preferably contain 3 to 10 more usually 3 or 4 carbon atoms and may be mono carboxylic such as methacrylic and acrylic acids or dicarboxylic such as maleic acid, maleic anhydride or fumaric acid.

Examples of unsaturated esters that may be used include aliphatic saturated mono alcohols of at least 1 carbon atom and preferably of from 12 to 20 carbon atoms such as decyl acrylate, lauryl acrylate, stearyl acrylate, eicosanyl acrylate, docosanyl acrylate, decyl methacrylate, diamyl fumarate, lauryl methacrylate, cetyl methacrylate, stearyl methacrylate, and the like and mixtures thereof.

Other esters include the vinyl alcohol esters of $C_2$ to $C_{22}$ fatty or mono carboxylic acids, preferably saturated such as vinyl acetate, vinyl laurate, vinyl palmitate, vinyl stearate, vinyl oleate, and the like and mixtures thereof.

Examples of suitable unsaturated nitrogen containing monomers containing 4 to 20 carbon atoms which can be used in (a) and (c) above include the amino substituted olefins such as p-(beta-diethylaminoethyl)styrene; basic nitrogen-containing heterocycles carrying a polymerizable ethylenically unsaturated substituent, e.g. the vinyl pyridines and the vinyl alkyl pyridines such as 2-vinyl-5-ethyl pyridine; 2-methyl-5-vinyl pyridine, 2-vinyl-pyridine, 3-vinyl-pyridine, 4-vinyl-pyridine, 3-methyl-5-vinyl-pyridine, 4-methyl-2-vinyl-pyridine, 4-ethyl-2-vinyl-pyridine and 2-butyl-5-vinyl-pyridine.

N-vinyl lactams are also suitable, and particularly when they are N-vinyl pyrrolidones or N-vinyl piperidones. The vinyl radical preferably is unsubstituted ($CH_2{=}CH{-}$), but it may be mono-substituted with an aliphatic hydrocarbon group of 1 to 2 carbon atoms, such as methyl or ethyl.

The vinyl pyrrolidones are the preferred class of N-vinyl lactams and are exemplified by N-vinyl pyrrolidone, N-(1-methylvinyl) pyrrolidone, N-vinyl-5-methyl pyrrolidone, N-vinyl-3,3-dimethyl pyrrolidone, N-vinyl-5-ethyl pyrrolidone, N-vinyl-4-butyl pyrrolidone N-ethyl-3-vinyl pyrrolidone. N-butyl-5-vinyl pyrrolidone, 3-vinyl pyrrolidone, 4-vinyl pyrrolidone, 5-vinyl pyrrolidone and 5-cyclohexyl-N-vinyl pyrrolidone.

Examples of olefins which could be used to prepare the copolymers of (b) and (c) above include mono-olefins such as propylene, 1-butene, 1-pentene, 1-hexene, 1-heptene, 1-decene, 1-dodecene, styrene, etc.

Representative non-limiting examples of diolefins that can be used in (c) include 1,4-hexadiene, 1,5-heptadiene, 1,6-octadiene, 5-methyl-1-4-hexadiene,1,4-cyclohexadiene, 1,5-cyclo-octadiene, vinyl-cyclohexane, dicyclopentenyl and 4,4'-dicyclohexenyl such as tetrahydroindene, methyl tetrahydroindene, dicyclopentadien, bicyclo(2,2,1)hepta-2, 5-diene, alkenyl, alkylidiene, 5-methylene-2-norbornene, 5-ethylidene-2-norbornene.

Typical polymeric viscosity index improver-dispersants include copolymers of alkyl methyacrylates with N-vinyl pyrrolidone or dimethylaminoalkyl methacrylate, alkyl fumarate-vinyl acetate N-vinyl pyrollidine copolymers, post-grafted interpolymers of ethylene-propylene with an active monomer such as maleic anhydride which may be further reacted with an alcohol or an alkylene polyamine, e.g. see U.S. Pat. Nos. 4,089,794, 4,160,739, 4,137,185; or copolymers of ethylene and propylene reacted or grafted with nitrogen compounds such as shown in U.S. Pat. Nos. 4,068,056, 4,068,058, 4,146,489, 4,149,984; styrene/maleic anhydride polymers post-reacted with alcohols and amines, ethoxylated derivatives of acrylate polymers, for example, see U.S. Pat. No. 3,702,300.

Typically the concentrates contain from 3 to 40 wt % of the polymeric viscosity index improver dispersant and are incorporated into the lubricating oil to provide 0.3 to 10 wt % of the polymeric viscosity index improver.

Any alkali metal compound that is reactive with the dispersant may be used. It may be lithium or potassium compound although sodium compounds are preferred, and suitable compounds include hydroxides, carbonates and similar basic salts. However, highly preferred are the oil soluble sodium compounds which may be colloidal sodium carbonate suspended in oil by a surfactant such as an alkyl aromatic sulphonic acid, alkyl phenols which may be sulphurised or polybutenes and phosphosulphurised polybutenes. Examples of these preferred sodium compounds are those described in U.S. Pat. No. 3,182,019. The sodium compound may be reacted with the dispersant by simple mixing of oil solutions of the two preferably at elevated temperature such as from 60° C. to 120° C. The amount of alkali metal compound used will depend upon the nature of the dispersant and the basic metal compound with which the dispersant is to be mixed in the concentrate. We find that from 0.001 gram atoms of alkali metal, especially sodium, per 100 g of dispersant generally gives the desired improvement in concentrate stability. Increasing the amount of alkali metal over the range of 0.001 to 0.075 gram atoms/100 g dispersant gives greater reduction in the viscosity of the resulting package containing the dispersant and a basic magnesium compound, but at the upper end of this range an increase in the amounts of alkali metal gives a smaller reduction in the resultant package viscosity, and if the amount of alkali metal is increased significantly beyond 0.075 gram atoms little additional benefit in viscosity reduction is seen. Since higher levels of alkali metals and particularly sodium may lead to unwanted interactions or to side effects such as deterioration of wear performance in the use of the packages in lubricating oils, the ability of the invention to achieve the desired effect at relatively low levels of alkali metal is highly advantageous. The amounts of alkali metal salt employed preferably corresponds to 0.01 to 0.05 gram atoms alkali metal/100 g dispersant.

It is a further surprising feature of the invention that the alkali metal-treated dispersant gives greatly improved compatability with oil-soluble basic magnesium compounds, but the same effect is not seen with other basic alkaline earth metal compounds such as the corresponding calcium compounds.

The basic oil soluble magnesium comopunds used in the concentrates of the present invention are generally the basic salts of sulphonic acids, alkyl phenols, sulphurised alkyl phenols, alkyl salicylates, naphthenates, or other oil soluble mono- and di-carboxylic acids.

Highly basic magnesium sulphonates are usually produced by heating a mixture comprising an oil-soluble alkaryl sulphonic acid with an excess of alkaline earth metal compound above that required for complete neutralization of the sulphonic acid and thereafter forming a dispersed carbonate complex by reacting the excess metal with carbon dioxide to provide the desired overbasing. The sulphonic acids are typically obtained by the sulphonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chloro-toluene and chloronaphthalene. The alkylation may be carried out in the presence of a catalyst with alkylating agents having from 3 to more than 30 carbon atoms such as for example haloparaffins, olefins that may be obtained by dehydrogenation of paraffins, polyolefins as for example polymers from ethylene or propylene. The alkaryl sulphonates usually contain from 9 to 70 or more carbon atoms, preferably from 16 to 50 carbon atoms per alkyl substituted aromatic moiety.

The magnesium compounds which may be used in neutralizing these alkaryl sulfonic acids to provide the sulphonates include the oxides and hydroxides, alkoxides, carbonates, carboxylate, sulphide, hydrosulfide, nitrate, borates and ethers of magnesium, calcium, and barium. Examples are magnesium acetate and magnesium borate. As noted, the magnesium compound is used in excess of that required to complete neutralization of the alkaryl sulphonic acids. Generally, the amount ranges from 100 to 220%, although it is preferred to use at least 125%, of the stoichiometric amount of metal required for complete neutralization.

Polyvalent metal alkyl salicylate and naphthenate materials are known additives for lubricating oil compositions to improve their high temperature performance and to counteract deposition of carbonaceous matter on pistons (U.S. Pat. No. 2,744,069). An increase in reserve basicity of the polyvalent metal alkyl salicylates and naphthenates can be realized by utilizing magnesium salts of mixtures of $C_8$–$C_{26}$ alkyl salicylates and phenates (see U.S. Pat. No. 2,744,069) or salts of alkyl salicyclic acids, said acids obtained from the alkylation of phenols followed by phenation, carboxylation and hydroylsis (U.S. Pat. No. 3,704,315) which could then be converted into highly basic salts by techniques generally known and used for such conversion. The reserve basicity of these metal-containing rust inhibitors is usefully at TBN levels of between about 60 and 150. Included with the useful polyvalent metal salicylate and naphthenate materials are the methylene and sulfur bridged materials which are readily derived from alkyl substituted salicylic or naphthenic acids or mixtures of either or both with alkyl substituted phenols. Basic sulfurized salicylates and a method for their preparation is shown in U.S. Pat. No. 3,595,791.

Alternatively the basic magnesium compound may be a sulfurized magnesium phenate which can be considered the "magnesium salt of a phenol sulphide" which thus refers to a salt, whether neutral or basic, of a compound typified by the general formula:

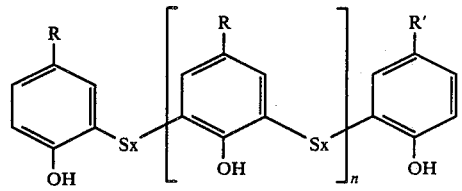

where x=1 or 2, n=0, 1 or 2 or a polymeric form of such a compound, where R is an alkyl radical, n and x are each integers from 1 to 4, and the average number of carbon atoms in all of the R groups is at least about 9 in order to ensure adequate solubility in oil. The individual R groups may each contain from 5 to 40, preferably 8 to 20, carbon atoms. The metal salt is prepared by reacting an alkyl phenol sulphide with a sufficient quantity of magnesium-containing material to impart the desired alkalinity to the sulphurized magnesium phenate.

Regardless of the manner in which they are prepared, the sulphurized alkylphenols which are useful contain from 2 to 14% by weight, preferably from 4 to 12 wt % sulphur based on the weight of sulphurized alkylphenol.

The sulphurized alkyl phenol is converted by reaction with a magnesium containing material including oxides, hydroxides and complexes in an amount sufficient to neutralize said phenol and, if desired, to overbase the product to a desired alkalinity by procedures well known in the art. Preferred is a process of neutralization utilizing a solution of metal in a glycol ether.

The neutral or normal sulphurized magnesium phenates are those in which the ratio of magnesium to phenol nucleus is about 1:2. The "overbased" or "basic" sulphurized magnesium phenates are sulphurized metal phenates wherein the ratio of magnesium to phenol is greater than that of stoichiometry, e.g. basic sulphurized magnesium dodecyl phenate has a metal content up to and greater than 100% in excess of the metal present in the corresponding normal sulphurized metal phenates wherein the excess metal is produced in oil-soluble or dispersible form (as by reaction with $CO_2$).

The present invention is equally applicable to concentrates containing mixtures of two or more of the oil soluble basic metal compounds described above.

The concentrates of the present invention may contain other additives especially those traditionally used in lubricating oils. Examples of such additives are the viscosity index improvers, pour point depressants and antioxidants such as the zinc dihydrocarbyldithiophosphates.

The present invention is illustrated but in no way limited by reference to the following Examples in which:

A. was an oil solution containing 52 wt % of a Magnesium Sulphonate containing 9 wt % Magnesium comprising colloidal Magnesium Carbonate in Magnesium Sulphonate derived from a sulphonate acid of average molecular weight of 480, the oil solution having a Total Base Number (TBN) of 400.

B. was an oil solution containing 55 wt % of the condensation product of approximately 2 moles of polyisobutenyl succinic anhydride—and 1 mole of a polyamine that had been treated with a boron compound to contain 1.5 wt % Nitrogen and 0.32 wt % Boron.

C. was an oil solution containing 57 wt % of the product obtained by carbonating a mixture of sodium hydroxide, nonyl phenol and phosphosulphurised polybutene as described in U.S. Pat. No. 3,182,019 containing 16.5 wt % sodium and about 0.5 wt % phosphorus.

D. was an oil solution containing 50 wt % of the active ingredient of B.

E. was an oil solution containing 47 wt % of an overbased sulphurized calcium alkyl phenate comprising approximately 30 wt % S and 9.5 wt % Ca and having a TBN of 250.

F. was an oil solution containing 53 wt % of a calcium sulphonate containing 11.9 wt % calcium and comprising colloidal calcium carbonate in calcium sulphonate derived from a sulphonic acid of average molecular weight of 480, the oil solution having a TBN of 300.

Reference is made to the accompanying drawing which is a graph of viscosity reduction against gram atoms of sodium per 100 g of dispersant used in Examples 1 to 5.

EXAMPLES 1 TO 5 AND COMPARATIVE EXAMPLE

The blends used in the Examples and Comparative Example which were prepared by mixing the ingredients in oil at 100° C. were as follows:

Comparative Example 1:
50 grams of A+50 grams of B mixed for 2 hours.

Example 1:
1 gram of C and 50 grams of B were mixed for 1 hour and 49 grams of A then added and mixing continued for one further hour.

Example 2:
Example 1 was repeated except that 5 grams of C and 45 grams of B were used.

Example 3:
Example 1 was repeated except that 10 grams of C and 40 grams of B were used.

Example 4:
Example 1 was repeated except that 0.5 grams of C and 49.5 grams of B were used.

Example 5:
Example 1 was repeated except that 0.1 grams of C and 49.9 grams of B were used.

The viscosity of the individual products A, B and C and of the products of Blends 1 to 4 were measured at 100° C. (by ASTM D 445) and found to be as follows:

| | gram atoms sodium/100 g dispersant | Viscosity (centistokes) | % Viscosity reduction |
|---|---|---|---|
| A | | 189 | |
| B | | 543 | |
| C | | 37 | |
| Comparative Example 1 | 0 | 2116 | 0 |
| Example 1 | 0.028 | 1360 | 35.7 |
| Example 2 | 0.057 | 1347 | 36.3 |
| Example 3 | 0.35 | 1241 | 41.4 |
| Example 4 | 0.014 | 1735 | 18.0 |
| Example 5 | 0.0028 | 1876 | 11.3 |

The results are illustrated in the accompanying drawing. The product of Comparative Example 1 was difficult to remove from the mixing vessel on cooling and suffered from stringing.

EXAMPLE 6 AND COMPARATIVE EXAMPLE 2

The procedure of the previous Examples was repeated using the following blends:

Comparative Example 2:
50 grams A+50 grams D mixed for 2 hours.

Example 6:
0.4 grams of potassium hydroxide in a minimum amount of water and 50 grams of D were mixed at 85° C., then the temperature raised to 100° C. for 1 hour. 50 grams of A were added and the mixing continued for 1 hour.

The viscosity of the individual products and of the blends were measured at 100° C., as follows:

| | gram atoms sodium/100 g dispersant | Viscosity (centistokes) | % Viscosity reduction |
|---|---|---|---|
| A | | 189 | |
| D | | 374 | |
| Comparative Example 2 | 0 | 490 | 0 |
| Example 6 | 0.028 | 377 | 23 |

COMPARARTIVE EXAMPLES 3 TO 8

The procedure of the previous Examples was repeated using the following blends:

Comparative Example 3:
50 grams B+50 grams E stirred for at 100° C. for 1 hour.

Comparative Example 4:
50 grams of B+1 gram of C stirred at 100° C. for 1 hour, 49 gram E added and stirring continued at 100° C. for a further hour.

Comparative Example 5:
Comparative Example 4 was repeated but with 5 grams of C and 45 grams of E.

Comparative Examples 6–8:
Comparative Examples 3 to 5 were repeated replacing additive E by additive F in the same amounts.

The viscosity of the blends was measured at 100° C. and found to be as follows:

| Comparative Example | Viscosity (c5) |
|---|---|
| 3 | 4199 |
| 4 | 4248 |

-continued

| Comparative Example | Viscosity (c5) |
|---|---|
| 5 | 7047 |
| 6 | 1389 |
| 7 | 3599 |
| 8 | 3722 |

The reduction in viscosity observed in an additive mixture containing an overbased magnesium compound was not observed in these blends.

I claim:

1. A process for improving the compatibility of an oil soluble nitrogen or ester-containing lubricating oil ashless dispersant with basic oil-soluble magnesium compounds useful as lubricating oil detergent additives comprising pre-reacting the dispersant with a basic salt of an alkali metal prior to mixing the dispersant with the magnesium compound, in which the amount of the alkali metal salt corresponds to from 0.01 to 0.075 gram atoms of alkali metal per 100 g of dispersant.

2. A process as claimed in claim 1, in which the amount of alkali metal salt corresponds to from 0.01 to 0.05 gram atoms of alkali metal per 100 g of dispersant.

3. A process as claimed in claim 1, in which the dispersant is pre-reacted with a basic salt of sodium or potassium.

4. A process as claimed in claim 3, in which the dispersant is pre-reacted with a sodium salt of a phenol sulphide.

5. A process as claimed in claim 1, in which the dispersant is a hydrocarbon-substituted succinic acid acylated aliphatic polyamine.

6. An additive concentrate for incorporation into lubricating oil containing from 0.2% to 5% by weight of an oil soluble basic magnesium compound and from 2% to 10% by weight of an ashless dispersant which contains from 0.001 to 0.075 gram atoms of an alkali metal per 100 grams dispersant.

7. A concentrate according to claim 6, in which the alkali metal is sodium.

8. A process according to claim 1, wherein said ashless dispersant is selected from the group consisting of esters and nitrogen-containing salts, amides, imides, and oxazolines of long chain hydrocarbon substituted mono and di carboxylic acids or anhydrides and wherein said basic magnesium compounds are selected from the group consisting of basic magnesium compounds of sulfonic acid, alkyl phenols, sulfurized alkyl phenols, alkyl salicylates and naphthenates.

9. A process according to claim 8, wherein said dispersant is a nitrogen-containing compound formed by the reaction of an alkenyl succinic anhydride wherein the alkenyl composition contains from 50–400 carbon atoms derived from a $C_2$–$C_5$ monoolefin, reacted with a polyethylene amine, an said alkali metal is sodium.

10. A process according to claim 9, wherein said ashless dispersant is the condensation reaction product of about 2 moles of polyisobutenyl succinic anhydride and about 1 mole of a polyamine, which condensation reaction product has been treated with a boron compound.

11. A process according to claim 9, wherein said magnesium compound is a basic magnesium sulphonate comprising colloidal magnesium carbonate and magnesium sulphonate.

12. A process according to claim 11, wherein said basic salt of sodium has been formed by treating with $CO_2$ a mixture of sodium hydroxide, nonyl phenol and phosphosulphurized polybutene.

13. A process according to claim 12, wherein said dispersant and said basic salt of sodium are pre-reacted together in an oil solution by mixing at a temperature in the range of about 60°–120° C.

* * * * *

UNITED STATES PATENT OFFICE
CERTIFICATE OF CORRECTION

Patent No. 4,502,971 Dated March 5, 1985

Inventor(s) Robert Robson

It is certified that error appears in the above-identified patent and that said Letters Patent are hereby corrected as shown below:

In the Specification:

Column 10, line 66, cancel "$C^5$" and substitute --cS--.

Column 11, line 1, cancel "C5" and substitute --cS--.

In the Drawing:

For the ordinate labelled "Viscosity Reduction (%)", cancel "1.0" and substitute --10--; cancel lowermost "3.0" and substitute --20--; cancel uppermost "3.0" and substitute --30--; cancel "4.0" and substitute --40--.

Signed and Sealed this

*Eighth* Day of *October 1985*

[SEAL]

*Attest:*

DONALD J. QUIGG

*Attesting Officer*

*Commissioner of Patents and Trademarks—Designate*